United States Patent [19]

Kastner

[11] Patent Number: 4,771,793

[45] Date of Patent: Sep. 20, 1988

[54] COMPACT CIGARETTE MAKING MACHINE

[76] Inventor: Arnold Kastner, 10220 Armand Laverne, Montreal, Quebec, Canada, H1H 3N5

[21] Appl. No.: 49,583

[22] Filed: May 13, 1987

[30] Foreign Application Priority Data

Mar. 20, 1987 [CA] Canada ..... 532644

[51] Int. Cl.[4] ..... A24C 5/40; A24C 5/42

[52] U.S. Cl. ..... 131/70; 131/75

[58] Field of Search ..... 131/70–74, 131/75, 76, 77

[56] References Cited

U.S. PATENT DOCUMENTS 4,632,129 12/1986 Kastner .

FOREIGN PATENT DOCUMENTS 909105 9/1972 Canada .

*Primary Examiner*—V. Millin

*Attorney, Agent, or Firm*—Browdy and Neimark

[57] ABSTRACT

A compact cigarette making machine is disclosed. The machine consists of a hollow channel-shaped base carrying a tobacco receiving member which is longitudinally slideable within the base. A cover is pivotally secured to the tobacco receiving member and is slidable therewith with respect to the base. An elongate tobacco injection spoon is removably carried by the base and is stationary therewith, as a hollow circular nipple for reception of a preformed cigarette tube is provided at the forward end of the tobacco receiving member. A tobacco receiving slot is provided in the tobacco receiving member and the cover is provided with a projection for compacting tobacco positioned in the slot. With the cover closed and tobacco positioned in the slot and a cigarette tube positioned on the nipple, rearward movement of the cover and tobacco receiving member with respect to the base results in the injection of a compacted wad of tobacco into the cigarette tube. The spoon and nipple which are the components most subject to gumming by the tobacco are easily removed for cleaning or replacement.

7 Claims, 3 Drawing Sheets

COMPACT CIGARETTE MAKING MACHINE

The present invention relates to a small, lightweight and economically manufactured cigarette making machine which is of small compact size and which may be readily carried in a pocket or purse to enable a cigarette to be made at any desired time. More specifically, the invention relates to a cigarette making machine of the injection type wherein a supply of tobacco is compacted into cylindrical form, and is injected into a preformed cigarette tube positioned on the machine.

The machine of this invention has a base of upwardly open channel shape and carries a removably positioned elongate tobacco injection spoon which has a concave cross-section. A tobacco receiving member is slideably positioned within the base and is movable to a position extending longitudinally outwardly from the rearward end of the base. The forward end of the tobacco receiving member has a removable partition which carries a hollow circular nipple to receive the open end of a preformed cigarette tube. The free end of the injection spoon passes through the hollow nipple during rearward movement of the tobacco receiving member with respect to the base. An elongate slot is provided in the tobacco receiving member to receive a quantity of tobacco, and a cover is pivotally secured to the rearward end of the tobacco receiving member and is slideable therewith with respect to the base. The cover is pivotally movable from open position to a closed position overlying the tobacco receiving member. The cover has a tobacco compacting projection which closes a top portion of the slot in the tobacco receiving member when the cover is in closed position. The cover is also provided with a cigarette tube retainer having a concave surface which bears against a cigarette tube positioned on the nipple to hold the tube in position during tobacco injection. Interengaging means are provided on the base and on the cover to clamp the cover to the base during rearward movement of the cover and the tobacco receiving member with respect to the base.

An object of the present invention is to provide a small compact cigarette making machine which can conveniently be carried in a pocket or purse and which is economical and durable in manufacture, and which has a minimum number of moving components and which avoids the complexities and disadvantages of prior art machines of this general type. A further feature of the invention is the ease and simplicity of disassembly of working component parts for cleaning and replacement.

THE PRIOR ART

Machines of the type wherein a supply of tobacco is compacted into cylindrical form by the pivoted lowering of a cover to compact the tobacco followed by the injection of the compacted tobacco into a pre-formed cigarette tube positioned on a nipple which is in axial alignment with the compacted tobacco are known.

In this regard, reference is made to Canadian patent No. 909,105, issued Sept. 5, 1972, in the name of Gizeh-Werk GmbH which provides apparatus for the injection of a compacted supply of tobacco into a pre-formed cigarette tube positioned in axial alignment with the tobacco chamber. In the arrangement of this patent, the cigarette tube is held on the nipple by a rather complicated spring-loaded assembly which is subject to wear during usage and is susceptible to malfunction due to the formation of tobacco gum which is unavoidable and disassembly of this spring-loaded assembly for cleaning is not possible with the assembly of this patent. With the apparatus of this patent, moreover, the cleaning of the various movable parts which contact and transfer the tobacco and which inevitably accummulate tobacco gum is most difficult and as these moving components are the ones most subject to wear, the inability to be able to easily clean or conveniently replace defective parts results in an assembly which has inherent disadvantages.

According to the present invention, the injection spoon assembly and nipple arrangement which are the components which require the most frequent cleaning and possible replacement are mounted on the machine for easy removal and replacement and which enable the user of the present machine to quickly and easily clean or replace parts as required in a manner not before possible.

A further difficulty with machines of the type disclosed in Canadian patent No. 909,105 and similar machines is that only soft and hotter-smoking cigarettes having insufficient tobacco can be satisfactorily made. If in the case of the machine according to the patent, a user attempts to add excess tobacco to obtain a firmer cooler smoking cigarette then injection becomes very difficult and the extra force involves often results in a breakage of the machine particularly in the area where the cover is pivotally connected to the base.

This difficulty is avoided by the present invention primarily through the use of a slide wedge-lock arrangement to secure the cover to the base and which enables firmer cooler-smoking cigarettes to be made while still providing for ease of injection without machine damage.

Another machine of this general type is described in U.S. Pat. No. 4,632,129 granted Dec. 30, 1986, to the present applicant, Arnold Kastner, and entitled CIGARETTE MAKING MACHINE. In the machine of this patent, an injection spoon is axially movable to inject a compacted wad of tobacco into a preformed cigarette tube and while this machine is durable and efficient in use, it must, because of its structure and operational movement, have a length which is greater than double the length of two cigarettes and as a result this machine does not lend itself well for ease of personal carriage.

The operation of the present invention is different from that of the machine of U.S. Pat. No. 4,632,129 and with the present machine the injection spoon is stationarily positioned within a base member of the machine which results in very compact size of a length only slightly greater than that of a cigarette.

The present inventive concept will now be more specifically described with reference to the accompanying drawings wherein like reference numerals refer to like parts.

BRIEF DESCRIPTION OF ACCOMPANYING DRAWINGS

DETAILED DESCRIPTION OF THE ACCOMPANYING DRAWINGS

The preferred embodiment of the present invention will now be specifically defined with reference to the accompanying drawings.

Figure 2:
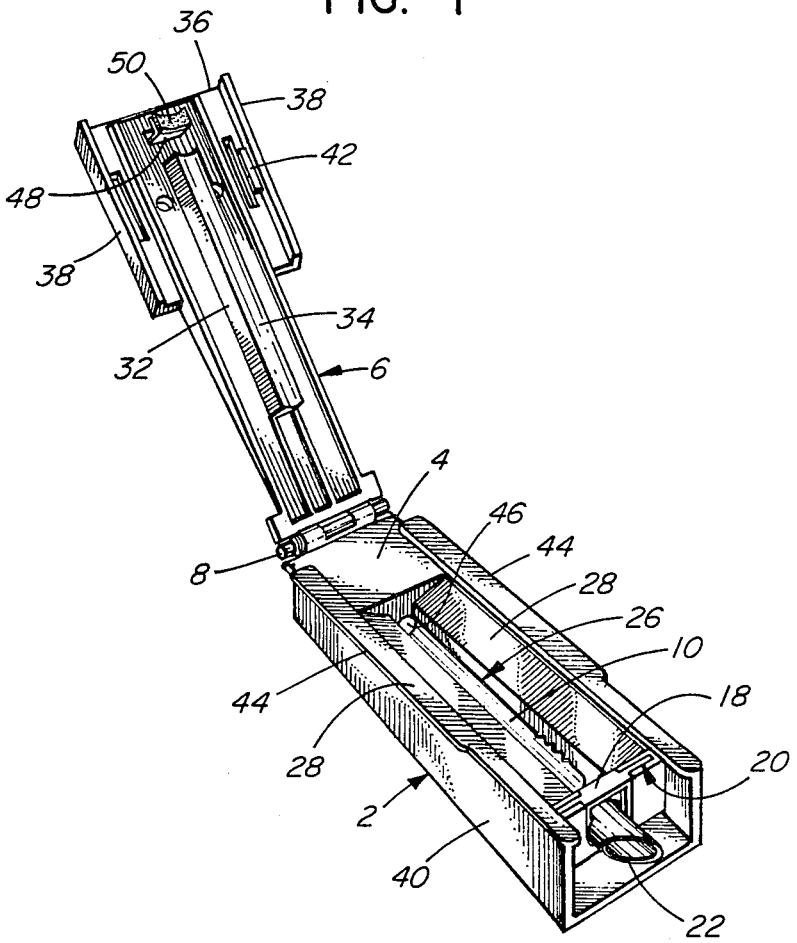
FIG. 2 is a perspective view of the machine according to FIG. 1, and showing the cover in open position.
Figure 4:
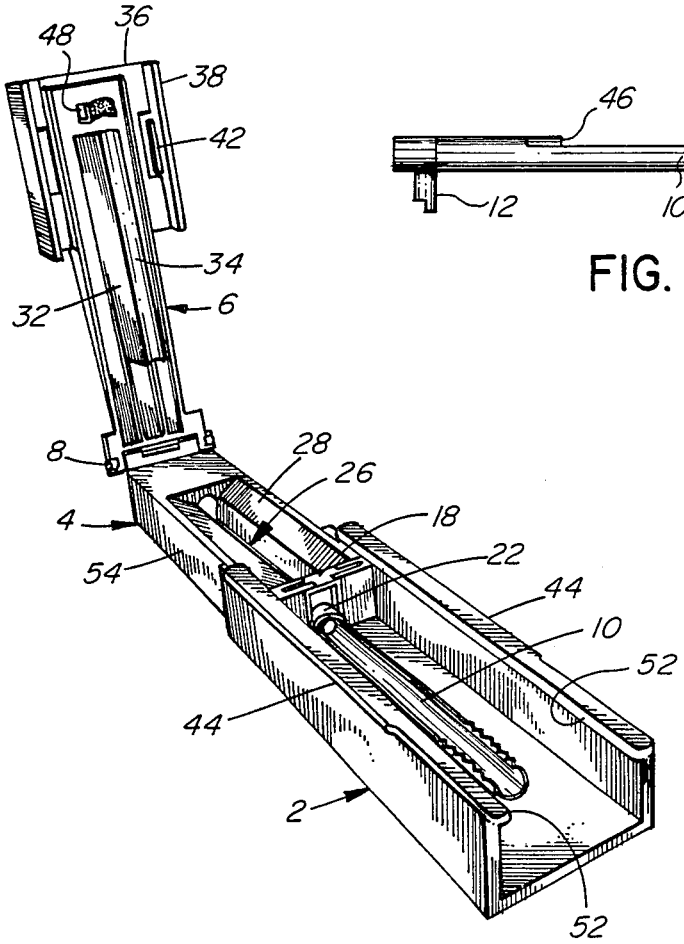
FIG. 4 is a front perspective view of the machine showing the inner slide portion of the machine moved rearwardly with respect to the base and the cover in open position.

With reference primarily to FIGS. 2 and 4, the present machine consists of three major component parts comprising a hollow channel-shaped base 2, a tobacco receiving member 4 which is slideably movable in the base 2 from the forward position shown in FIG. 2 to the rearward position shown in FIG. 4, and a cover portion 6 which is pivotally hinged to the rear of the tobacco receiving member by suitable means such as pivot pin 8.

These three component parts 2, 4, and 6 may conveniently be molded of suitable plastics material for economy of manufacture, although other materials such as metals could be used if desired.

Figure 5:
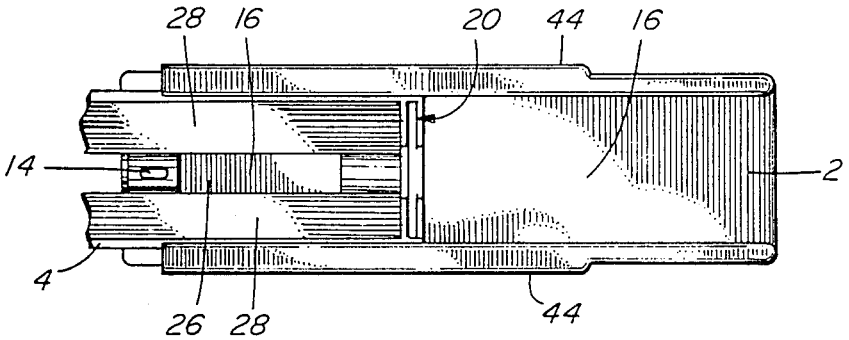
FIG. 5 is a top view of the front portion of the assembly shown in FIG. 4, showing the base member and the front portion of the inner slide member, and appears on the sheet with FIG. 3.
Figure 6:
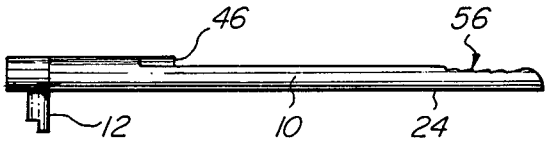
FIG. 6 is a side view of the injection spoon used in the present machine, and appears on the sheet with FIG. 4.

An injection spoon 10 (see FIGS. 4 and 6) is secured within base 2 and is stationary therewith. The spoon which may be of metal or plastic is removably secured to the base to facilitate cleaning and/or replacement if necessary. As shown in FIG. 6, the rear of the spoon 10 is provided with a downwardly extending flange 12 which, when the spoon is positioned in the base, extends downwardly into a small opening 14 (see FIG. 5) provided in the bottom surface 16 of the base 2.

The tobacco receiving member 4 carries at its forward end a removable partition 18 which is received in slots 20 (see FIG. 2) provided on both sides of the tobacco receiving member 4. Secured to the partition 18 is a circular hollow nipple 22 which is adapted for insertion into the open end of a preformed paper cigarette tube. The outer diameter of the nipple 22 is of a size to snugly receive the open end of a cigarette tube thereover.

As partition 18 and nipple 22 which may be of plastic or metal as desired, are readily removable from the machine cleaning and/or replacement is facilitated.

As the injection spoon 10 is securely held by the base and as partition 18 and nipple 22 are movable with the tobacco receiving member 4, rearward movement of the tobacco receiving member 4 with respect to the base 2 will result in the free end 24 of the spoon 10 passing through and extending beyond tbe nipple 22 as clearly shown in FIG. 4.

As shown in FIGS. 2 and 4, the central portion of the tobacco receiving member 4 is provided with a slot opening 26 with upper outwardly sloping surfaces 28. When the tobacco receiving member 4 is positioned forwardly within base 2 as shown in FIG. 2, the upwardly concave spoon 10 is positioned directly beneath the slot 26 and a quantity of tobacco sufficient for one cigarette is positioned within slot 26 and pushed downwardly into contact with the injection spoon 10. This positioning of the tobacco in the slot is facilitated by the inwardly sloping surfaces 28 and also through the use of a tamper of the type shown at 30 in FIG. 7.

Figure 1:
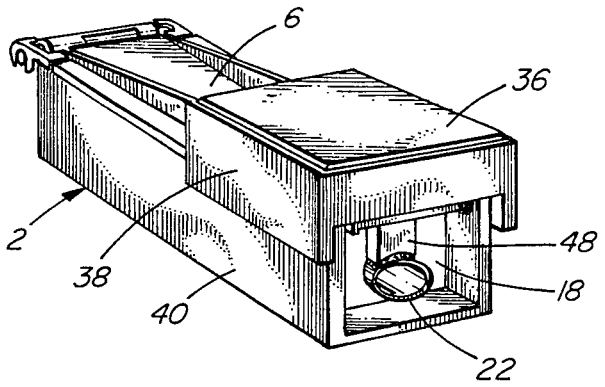
FIG. 1 is a front perspective view of the compact cigarette making machine of the present invention.

As discussed above, the cover 6 is pivotally secured to the tobacco receiving member 4 and is movable from closed position shown in FIG. 1 to an open position shown in FIGS. 2 and 4. On its lower surface, the cover 6 is provided with a tobacco compacting projection 32 having a lower surface 34 which is concave in cross-section and which is of a size to be received within the slot 26 provided in the tobacco receiving member 4 when the cover is lowered to the position shown in FIG. 1. In this position, of course, the tobacco which is to be injected into a preformed cigarette tube (shown in broken lines in FIG. 3) is compacted and more or less shaped by confinement within a cavity formed by the upper concave surface of the spoon 10, the side walls of the slot 26 and the lower concave surface 34 of the tobacco compacting projection carried by the cover.

The forward end of the cover 6 is provided with an enlarged portion 36 in the form of a handle and which is an integral portion of the cover. As shown in FIGS. 1 and 4, the exterior side walls 38 of the handle portion 36 project downwardly a distance over the outer side surfaces 40 of the base, and as shown in FIGS. 2 and 4, the inner surfaces (not numbered) of the side walls of the handle portion are provided with inwardly directed ribs 42, the purpose of which will be discussed below. Also as clearly shown in FIGS. 2, 3, and 4, the upper rearward portions of the side walls 40 of the tobacco receiving chamber 4 are provided with outwardly extending ribs or ridges 44 and during rearward movement of the tobacco receiving member 4 and cover 6, the ribs 42 provided on the cover engage beneath the ribs 44 provided on the base to tightly clamp the cover to the base during rearward movement of the cover and tobacco receiving member.

It is during rearward movement of the cover and tobacco receiving member with respect to the base that a compacted wad of tobacco is injected into a preformed cigarette tube positioned on the nipple 22. As shown in FIG. 6, the spoon 10 is provided with a stop or abutment 46 which ensures that the tobacco positioned on the spoon is carried into the cigarette tube. When the cover 36 is pushed to the rear, it will be evident that the entire cigarette tube is displaced.

A cigarette tube is held in position on the nipple 22 by a cigarette tube retainer 4B provided on the underside of the cover and forwardly of the tobacco compactor 32 as shown in FIGS. 2 and 4. When a cigarette tube is positioned on the nipple and the cover lowered, the cigarette tube retainer contacts the tip of the cigarette tube and holds the tube in position on the nipple during the injection process (see FIG. 3). Conveniently, the concave lower surface of the tube retainer may be provided with a thin layer 50 (see FIG. 4) of a compressible material such as sponge rubber or foam plastic to snugly secure the tube onto the nipple without danger of tearing the cigarette paper tube.

As shown in FIG. 4, the tops of the side walls 40 of the base 2 are provided with inwardly directed flanges 52 which project inwardly over the side walls 54 of the tobacco receiving member to slideably hold the tobacco receiving member within the base.

The forward end 24 of the injection spoon 10 may, if desired, be provided with small serrations 56 which engage tobacco compacted on the spoon to facilitate injection into a tube.

Figure 3:
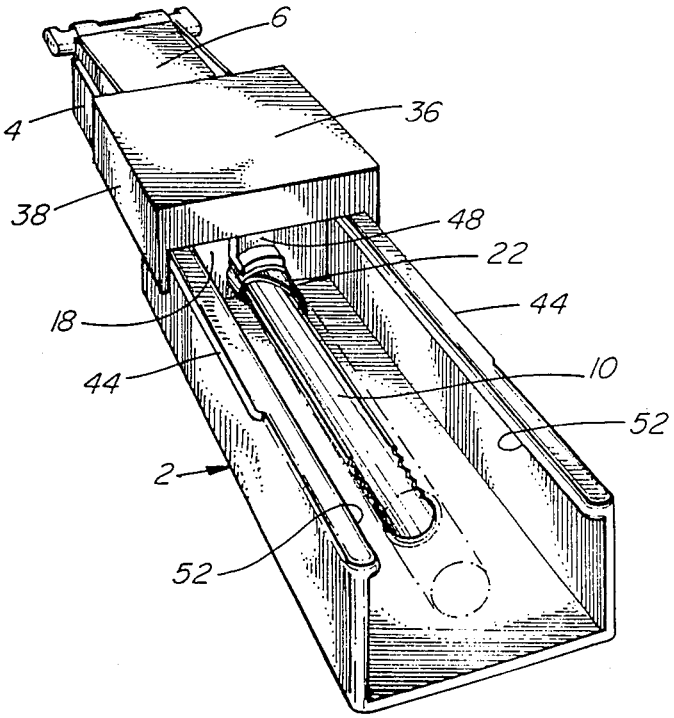
FIG. 3 is a perspective view showing the cover in lowered locked position and moved rearwardly with respect to the base in tobacco injecting position.
Figure 7:
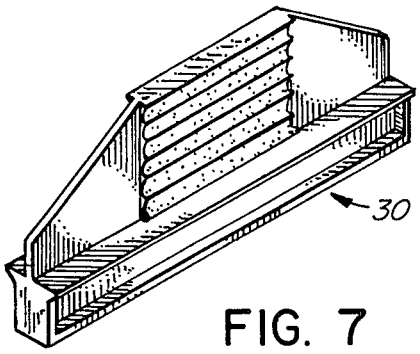
FIG. 7 is a perspective view of a tamper which can conveniently be used with the present machine to compact the tobacco prior to injection into a preformed cigarette tube, and appears on the sheet with FIG. 4.

To use the machine, the cover 6 is first opened to the position shown in FIG. 2, and the open end of a preformed cigarette tube positioned on nipple 22. Then, with the tobacco receiving member 4 positioned completely within the base 2 as shown in FIG. 2 a supply of tobacco sufficient for one cigarette is placed into the tobacco receiving slot 26 and pressed into the slot either with the fingers or by using tamper 30 as shown in FIG. 7. The cover is then closed to the position shown in FIG. 1 wherein the cigarette tube retainer 48 contacts and hold the tip of a cigarette tube on nipple 22. The base 2 of the machine is then held with one hand while the other hand slides the cover and the tobacco receiving member rearwardly with respect to the base to the position shown in FIG. 3. As discussed above, and as the injection spoon 10 is stationary with respect to the base and as the cigarette tube is carried rearwardly by nipple 22, the forward portion of the spoon and the wad of tobacco (not shown) enter the cylindrical cavity of the cigarette tube. This position is shown in FIG. 3.

The cover is then moved forwardly with respect to the base to the forward position shown in FIG. 1, and the cover raised (see FIG. 2) to remove the tube retainer from the cigarette tube to permit removal of the finished cigarette from the nipple.

I claim:

1. A compact cigarette making machine of the type wherein a quantity of tobacco is formed into elongate shape and inserted into a preformed cigarette tube, comprising a base of upwardly open channel shape having forward and rearward ends and an elongate tobacco injection spoon having a free end and having a concave cross-section removably secured within the base and stationary therewith, and a tobacco receiving member positioned within the base and slideably movable to a position extending longitudinally outwardly from the rearward end of the base, the tobacco receiving member having at its forward end a removable partition carrying a hollow circular nipple to receive the open end of a preformed cigarette tube, the free end of the injection spoon passing through the hollow nipple during rearward movement of the tobacco receiving member with respect to the base, and an elongate slot provided in and extending through the tobacco receiving member to receive a quantity of tobacco, and a cover pivotally secured to the rearward end of the tobacco receiving member and slideable therewith with respect to the base, the cover being pivotally movable from open position to a closed position overlying the tobacco receiving member, and a tobacco compacting projection having a lower surface which is concave in cross-section carried by the cover and which closes a top portion of the said elongate slot when the cover is in closed position, and a cigarette tube retainer having a circular concave surface on the cover forwardly of the tobacco compacting projection, the concave surface of the retainer bearing against a cigarette tube positioned on the nipple to hold the tube in position during tobacco injection, and interengaging means provided on the base and on the cover to clamp the cover to the base during rearward movement of the cover and the tobacco receiving member with respect to the base.

2. A compact cigarette making machine according to claim 1, wherein sides of the base are provided along their rearward top surfaces with outwardly extending ribs for engagement beneath inwardly directed ribs provided on both sides of the cover at a forward portion thereof, the said ribs providing the said interengaging means for clamping of the cover.

3. A compact cigarette making machine according to claim 1, wherein the injection spoon is provided with an abutment at a distance from its free end approximating the length of opening in a preformed cigarette tube.

4. A compact cigarette making machine according to claim 1, wherein the injection spoon is provided at its end remote from its free end with a downward projection which engages in an opening provided at the rearward end of the base in its bottom to removably secure the spoon within the base.

5. A compact cigarette making machine according to claim 1, wherein edges at the free end of the injection spoon are serrated.

6. A compact cigarette making machine according to claim 1, wherein opposite sides of the forward end of the tobacco receiving member are provided with slots for removable reception of the partition carrying the nipple.

7. A compact cigarette making machine according to claim 1, wherein the concave surface of the tube retainer is lined with a compressible material.

* * * * *